United States Patent [19]

Ting

[11] 4,316,351

[45] Feb. 23, 1982

[54] THERMALLY INSULATED BUILDING CONSTRUCTION PANEL AND A WALL FORMED FROM SUCH PANELS

[76] Inventor: Raymond M. L. Ting, 318 Holiday Dr., Pittsburgh, Pa. 15237

[21] Appl. No.: 153,259

[22] Filed: May 27, 1980

[51] Int. Cl.[3] ..... E04C 1/10; E04C 2/20; E04B 1/41; E04B 2/72

[52] U.S. Cl. ..... 52/309.9; 52/512; 52/520; 52/595; 52/802; 52/478

[58] Field of Search ..... 52/483, 309.9, 309.4, 52/588, 593, 478, 594, 595, 520, 521, 512

[56] References Cited

U.S. PATENT DOCUMENTS

| | | | |
|---|---|---|---|
| 3,667,180 | 6/1972 | Tischuk | 52/309.9 |
| 3,714,747 | 2/1973 | Curran | 52/309.9 |
| 3,777,430 | 12/1973 | Tischuk | 52/309.9 |
| 3,828,493 | 8/1974 | Vezmar | 52/483 |
| 4,104,840 | 8/1978 | Heintz | 52/309.9 |
| 4,109,437 | 8/1978 | Player | 52/478 |
| 4,123,885 | 11/1978 | Scott | 52/802 |
| 4,177,615 | 12/1979 | Anderson | 52/478 |
| 4,184,301 | 1/1980 | Anderson | 52/309.9 |
| 4,195,459 | 4/1980 | Anderson | 52/309.9 |
| 4,195,460 | 4/1980 | Anderson | 52/309.9 |
| 4,196,554 | 4/1980 | Anderson | 52/309.9 |
| 4,244,151 | 1/1981 | Seem | 52/309.9 |
| 4,267,679 | 5/1981 | Thompson | 52/802 |

*Primary Examiner*—Reinaldo P. Machado
*Attorney, Agent, or Firm*—Harry B. Keck

[57] ABSTRACT

A thermally insulated wall panel for building construction having a metal liner panel and a metal facing panel with interconnected side-joint profiles which provide positive connections of facing panels of adjoining wall panels when outward stress is applied. Positive connections of the liner panels of adjoining wall panels can be obtained when outward stress is applied.

7 Claims, 3 Drawing Figures

THERMALLY INSULATED BUILDING CONSTRUCTION PANEL AND A WALL FORMED FROM SUCH PANELS

BACKGROUND OF THE INVENTION

1. Field of the Invention

This invention relates to thermally insulated building construction panels of the type formed by a pair of spaced apart metal skins and an interposed thermal insulation material which adhesively binds the metal skins together into a panel and more particularly to improved side-joint construction for assembling such panels into a wall.

2. Description of the Prior Art

Building construction panels having metal liner sheets, metal facing sheets and an interposed core of thermal insulation such as polyurethane foam are well known. A variety of connecting side joints for such construction panels has been proposed. Some of the side joints are designed to permit the fabrication of the building construction panel from identical metal facing sheets and liner sheets so that the panel fabricator requires only a single roll-former line or process to produce the matel facing sheets and liner sheets for the panel. It is also known to assemble building construction panels from liner sheets having different joint configuration profiles from the profiles of the facing sheets. The use of threaded fasteners, hidden from view, to secure such building construction panels to a building framework is commonplace. The use of supplemental metal clamping plates to retain the panels in position also is well known.

A principal shortcoming of the thermally insulated, double-skinned metal panels of the prior art is their unsatisfactory performance in fire tests. Frequently the panels are fabricated with polyurethane foam as the core material. While the combustability of polyurethane foam is well known, the thermal insulating character of such polyurethane foams is excellent. When the polyurethane foam is encapsulated within the metal skins of a double metal skin panel, the fire performance of the resulting panel is surprisingly good until that stage of the fire test where the panel joints spring open and allow the polyurethane foam to become exposed. The panels normally fail the fire tests at that stage. A panel joint which resits disengagement under stress will improve the panel fire rating.

Another difficulty with existing insulated double-skin panels is that the side joint has been the critical limiting strength component of a wall assembled from such panels. Hence the side joint has been a limiting consideration in establishing maximum panel width. By developing a stronger side joint construction which resists slippage and disengagement under stress, other panel parameters become controlling in width determination and wider panels can be successfully produced. Wider panels in general reduce construction costs and improve the fire endurance properties of the resulting panel wall by providing fewer joints over a wall surface.

SUMMARY OF THE INVENTION

The wall panel of this invention includes a pair of opposed metal facing sheets, each having different side joint configurations. One of the panel sheets is identified as a liner sheet and is the surface which is secured to a supporting framework. The other panel sheet is a facing sheet which is exposed to view and exposed to the weather in external walls. The facing sheet overlies and is generally parallel to the liner sheet. The facing sheet and liner sheet are spaced apart, i.e., they are not in metal-to-metal contact at any point, thereby maintaining outstanding thermal insulating properties for the panel. The liner sheets of abutting panels have wall surfaces extending normally from the building framework which are abutted to produce a wall assembly. The facing sheets of abutting panels have sloping wall surfaces which are in sliding engagement. For the purposes of the following discussion, two abutting panels will be identified as a first panel and a second panel wherein the first panel is the one which is initially secured to the building framework and the second panel is the one which engages with the already installed first panel. Each panel has a first edge and a second edge. The first edge of the first panel is fastened by engagement with a previously installed like panel or by engagement with suitable starter brackets or panel segments as is well known in the art. The first panel is secured to installing a fastener, usually a screw, through a facing sheet flange disposed between the facing sheet and the liner sheet. The fastener extends though the facing sheet flange and through the liner sheet into engagement with the building framework. A metal clamp is provided between the head of the fastener and the facing sheet flange. The metal plate also engages a liner sheet flange which extends from the liner sheet between the liner sheet and the facing sheet in the same plane as the first-mentioned facing sheet flange. Thereby the metal plate provides a positive mechanical engagement for the second edge of the first panel. The essential features of the secured first panel are a sloping wall surface in the facing sheet terminating in a first shoulder which is positioned between the liner sheet and the facing sheet; a normal wall surface extending from the liner sheet toward the facing sheet between the metal plate and the liner sheet; and a hook-shaped cross-section member extending outwardly and away from the liner sheet.

The second panel is assembled by inserting the first edge of the second panel into interconnecting relation with the second edge of the secured first panel.

The first edge of the second panel has a sloping wall surface which engages with the sloping wall surface of the secured first panel and has a gutter member which receives the first shoulder of the second edge of the assembled first panel. The second panel is pivoted until the liner sheet of the second panel engages the building framework in the assembled position. The normal wall surfaces which extend from the liner sheets of each panel are abutted. The hook-shaped cross-section member from the liner sheet of the first panel extends into a groove within the first edge of the second panel.

Thereafter the second edge of the second panel is secured with a fastener and a third panel is secured to the second panel, et cetera, completing a building wall.

The essential feature of this invention is the provision of a mechanical engagement between the liner sheet of the first panel and the liner sheet of the second panel—and—a mechanical engagement between the facing sheet of the first panel and the facing sheet of the second panel. Of particular significance is the fact that the mechanical engagements increase resistance to disengagement as the panel joint experiences stresses which would tend to cause slippage of the engaged liner sheets and slippage of the engaged facing sheets. Sloping wall surfaces of the facing sheets direct panel disengagement stresses into the described mechanical engagements.

DESCRIPTION OF THE PREFERRED EMBODIMENTS

Figure 1:
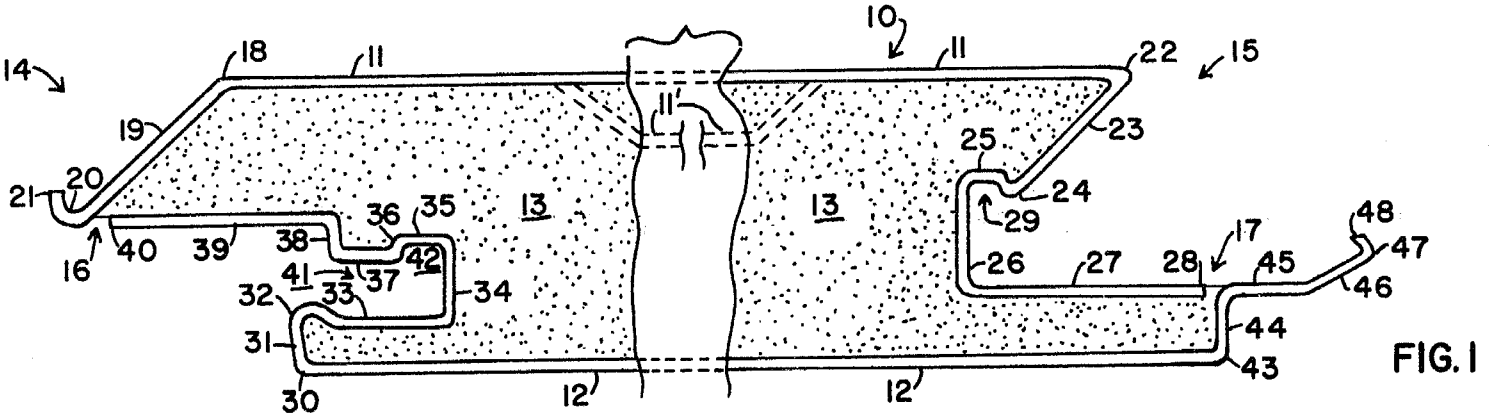
FIG. 1 is a fragmentary cross-section view of a building construction panel according to this invention.

FIG. 1 shows a double-skin building panel of this invention including facing sheet 11, a liner sheet 12 and structural thermal insulation 13 which is adhesively secured to the inner surfaces of the facing sheet 11 and liner sheet 12. Each panel 10 has a first edge 14 and a second edge 15. In general, the liner sheets 12 and facing sheets 11 are fabricated from metals such as painted steel, aluminum, aluminized steel, stainless steel and the like in gauges of 26 gauge to about 14 gauge. Most building panels have a metal thickness of 18 to 22 gauge. Panels customarily have a width of 60 to 90 cm and are supplied in lengths from about ½ meter to about 12 meters. The panel thickness ranges from about 35 to 100 mm. Customarily the liner sheet 12 has a flat surface as shown in FIG. 1 except for the joint-forming features along each side of the liner sheet 12. The liner sheet 12 may have small corrugations or other deformations for aesthetic or strengthening purposes.

Customarily the facing sheet 11 is a flat surface between the joint forming side edges as shown in FIG. 1. However, the facing sheet 11 may be suitably profiled for aesthetic purposes and to reduce the volume of each panel and thereby to reduce the amount of thermal insulation 13 which is required to complete the panel. A typical profiling pattern 11' is shown in FIG. 1.

The structural insulating material 13 preferably is foamed-in-place polyurethane foam having a density of 2 to 5 pcf. Polyurethane foam provides excellent thermal insulation properties and also provides, when properly applied, excellent adhesion to the liner sheet 12 and the facing sheet 11. It will be observed that the structural insulation terminates in a gap 16, 17 at each edge of the panel 10 between the liner sheet 12 and the facing sheet 11.

Other foamed substances may be employed to produce the present panel, for example, polyisocyanurate foam, preformed batts of thermal insulation such as polyurethane foam batts, polyisocyanurate batts, phenolic foam batts, expanded polystyrene batts, which are secured to the facing sheet 11 and liner sheet 12 by appropriate adhesive substances. A further type of structural thermal insulation which may be employed is honeycomb filler which is secured between the facing sheet 11 and liner sheet 12 by means of a suitable adhesive and wherein the first edge 14 and second edge 15 of the panel are filled with preformed, shaped insulating spacers or foamed-in-place plastics.

Facing Sheet, First Edge

The first edge 14 of the facing sheet 11 includes a first lateral corner 18, a first sloping wall surface 19, a first gutter 20 and a free edge 21. The angle of the sloping wall surface 19 with respect to the plane of the facing sheet 11 is between 30 and 60 degrees, and is preferably determined by the geometry of the resulting joint which will permit the second panel to be connected to a first secured panel.

Liner Sheet, Second Edge

The second edge 15 of the liner sheet 11 has a second lateral corner 22, a second sloping wall surface 23 which is essentially parallel to the first sloping wall surface 19. The second sloping wall surface 23 connects with a first shoulder 24 having a shoulder surface facing away from the facing sheet 11. The first shoulder 24 connects with a first groove forming surface 25 which is essentially parallel with the facing sheet 11 and which connects to a first normal wall surface 26 which in turn connects to a first outboard flange 27 having a free edge 28. The first outboard flange 27 is essentially parallel to the facing sheet 11.

The shoulder 24, first groove forming surface 25 and a portion of the first normal wall surface 26 define a first groove 29. It will be observed that the free edge 28 is located outboard from the second lateral corner 22.

Liner Sheet, First Edge

The first edge 14 of the liner sheet 12 ends in a third lateral corner 30 from which a third normal surface 31 extends toward a second shoulder 32 having a shoulder surface facing away from the liner sheet 12. The third shoulder connects to a second groove forming surface 33 which is essentially parallel to the liner sheet 12. The second groove forming surface 33 connects to a fourth normal surface 34 which connects to a third groove forming surface 35 which is essentially parallel to the liner sheet 12. The third groove forming surface 35 connects to a fifth normal surface 36, a third shoulder 37 and a sixth normal surface 38. The third shoulder faces the liner sheet 12. The sixth normal surface 38 joins a second outboard flange 39 having a free edge 40. The second outboard flange 39 is essentially parallel to the liner sheet 12. It will be observed that the free edge 40 extends outboard beyond the third lateral corner 30 of the liner sheet 12.

A second groove 41 is formed by the second groove forming surface 33, the fourth normal surface 34, and the combination of the third groove forming surface 35, the fifth normal surface 36, and the third shoulder 37. A third groove 42 is formed by the fourth normal surface 34, the third groove forming surface 35 and the fifth normal surface 36.

Liner Sheet, Second Edge

The second edge 15 of the liner sheet 12 has a fourth lateral corner 43 and a seventh normal wall surface 44 which connects with a third outboard flange 45 terminating with a third sloping wall surface 46 and a hook-shaped cross-section member 47 having a free edge 48.

The first gap 16 and the second gap 17 preferably have a width of 3 to 12 mm to provide a thermal break between the liner sheet 12 and the facing sheet 11.

Panel Assembly

Figure 2:
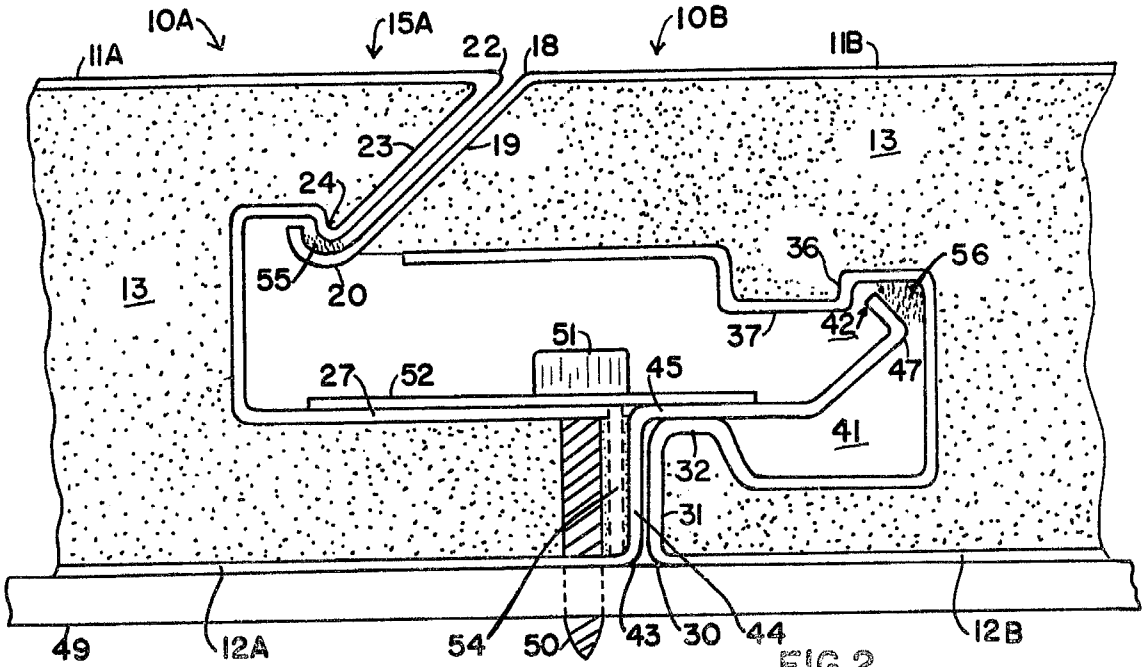
FIG. 2 is a fragmentary cross-section view of two assembled building panels of this invention showing the manner in which the building panel joint fits together.
Figure 3:
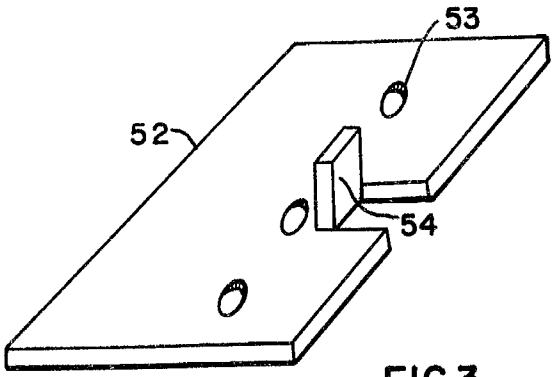
FIG. 3 is a perspective view of a bracket which is employed in the assembly of this panel joint.

Multiple panels of this invention are secured to a building framework by means of fasteners such as screws and associated bracket members of the type shown in FIG. 3. As shown in FIG. 2, a first panel 10A is initially secured to a building framework designated generally by the numeral 49 which, in a typical building, would be a horizontal beam, girder or subgirt to which a threaded fastener 50 can be secured. The panels of this invention are particularly adapted to being assembled horizontally in which assembly the building structural element 49 is a column or vertical mullion. The first panel 10A is secured to the building framework 49 at its first edge (not shown in FIG. 2) and its second edge 15A is secured to the building framework 49 by means of the threaded fastener 50 which has an enlarged head portion 51. The fastener 50 extends through a bracket 52 (shown in FIG. 3), the first groove forming surface 27, a portion of the structural thermal insulation and thence through the liner sheet 12 into the building structure 49.

The bracket 52 as shown in FIG. 3 is a rectangular plate having plural fastener receiving openings 53 and having at least one bent tab 54 which penetrates the structural thermal insulation through the second gap 17 and engages the inner surface of the liner sheet 12 adjacent to the fourth lateral corner 43. The flat plate portion of the bracket 52 overlies the first outboard flange 27 and the third outboard flange 45 which are coplanar in the assembled panel. The secured bracket 52 provides a mechanical connection for both the facing sheet 11 and the liner sheet 12 with the building structure 49.

The first panel 10A is thus secured by means of a sufficient number of fasteners 50 and brackets 52, spaced in accordance with the structural requirements of the building. Typically fastening brackets are provided along the length of the panel connecting joint every one-to-five meters.

The second panel 10B is next secured by introducing the second panel 10B at an angle to the plane of the building structure 49 whereby the shoulder 32 slides between the third outboard flange 45 and the building structure 49. The panel 10B is pivoted until its liner sheet 12B engages the building structure 49.

The sloping wall surfaces 19, 23 are in engagement and the lateral corners 18, 22 are aligned. The seventh normal wall surface 44 is in confronting relation with the third normal wall surface 31; the lateral corners 30, 43 are aligned. The second shoulder 32 bears against the inboard surface of the third outboard flange 45; the hook-shaped cross-section member 47 fits in the third groove 42. The first end of the second panel 10B is thus secured. The installer proceeds to the second end of the panel 10B (not shown) and secures it in a similar fashion.

A bead 55 of weather-resistant caulking material is provided in the gutter 20 before the panels are assembled. The bead 55 of weather-resistant caulking material forms a weathertight seal between the facing sheets 11A, 11B.

A similar bead 56 of caulking material may be provided in the third groove 42 to provide a weathertight seal with the hook-shaped cross-section member 47.

It will be observed that any stresses which may be applied to the resulting building wall tending to cause disengagement of the joint or to cause opening of the joint will be mechanically resisted. Separation of the facing sheets 11A, 11B is opposed by the overlapping connection of the gutter 20 with the first shoulder 24. Separation of the liner sheets 12A, 12B is resisted by the engagement of the hook-shaped surface 47 with the fifth normal surface 36 which defines the third groove 42. Because of the sloping surfaces 19, 23, any panel disengagement stresses tend to increase the engagement of the gutter 21 with the shoulder 24 and the engagement of the hook-shaped cross-section member 47 in the third groove 42.

The benefits of this invention may be achieved by eliminating the cross-section hook-shaped member 47, the third sloping surface 46 and their functions. In this alternative construction, the panel disengaging stresses will be resisted by the engagement of the gutter 20 with the shoulder 24. Any outwardly applied disengaging stresses will be transferred in a direction which increases the engagement between the interlocking gutter 20 and shoulder 24.

Horizontal Assembly

The panels of this invention may be assembled horizontally to great advantage. As shown in FIG. 1, the panels are assembled from top-to-bottom with the first edge 14 being the uppermost edge and the second edge 15 being the bottom edge. The sloping wall surfaces 19, 23 are thereby arranged to minimize water entry into the joint assembly.

I claim:

1. In a building panel wall assembly formed from individual building panels, each panel having an outer metal facing sheet, an inner metal facing sheet and a thermal insulation core adhesively connecting said metal sheets, wherein said outer facing sheet and said inner facing sheet have lateral profiled joint-forming surfaces for connecting a pair of said panels in side-by-side relation to a building frame; the improvement comprising:

said facing sheets having lateral corners, parallel sloping sidewalls extended one from each of said lateral corners toward the said liner sheet;

a lengthwise gutter open toward said facing sheet along a first side edge at the end of a first of said sloping sidewalls;

a lengthwise shoulder confronting the said liner sheet along a second side edge at the end of the second of said sloping sidewalls;

said panels being assembled with said gutter of one panel receiving said first shoulder of the adjoining panel and with the sloping sidewall of one panel abutting the sloping sidwall of the other panel.

2. The building panel wall assembly of claim 1 wherein said facing sheet has a joint-forming surface connected to said lengthwise shoulder and essentially parallel to said liner sheet and has at least one fastener extending through said joint-forming surface to secure said facing sheet to said building frame.

3. In a building panel wall assembly formed from individual building panels, each panel having an outer metal facing sheet, an inner metal facing sheet and a thermal insulation core adhesively connecting said metal sheets, wherein said outer facing sheet and said inner facing sheet have lateral profiled joint-forming surfaces for connecting a pair of said panels in side-by-side relation; the improvement comprising:

(1) said facing sheet having a lengthwise gutter open toward said facing sheet along the first edge and having a lengthwise shoulder confronting the said liner sheet along a second edge;

(2) said liner sheet having a groove along its first edge facing the said liner sheet and having a hook-shaped member along its second edge;

said panels being assembled with said gutter receiving said first shoulder and with said hook-shaped member engaged with said groove.

4. A building construction panel formed from an outer metal facing sheet, an inner metal lining sheet and a thermal insulation therebetween which adhesively connects the said metal sheets;

said facing sheet having a first side edge and a second side edge;

the first side edge of said facing sheet having a first lateral corner extending lengthwise of the facing sheet;

a first sloping wall surface extending downwardly and outwardly from said first lateral corner and terminating in a first gutter having a free edge facing toward said facing sheet;

the second edge of said facing sheet having a second lateral corner extending lengthwise of the facing sheet and connecting to a second sloping wall surface which extends downwardly and inwardly from said second lateral corner and which is essentially parallel to said first sloping wall surface and terminating in a first shoulder which is connected to a first groove-forming surface, essentially parallel to said facing sheet, and in turn connected to a first normal wall surface extending away from said facing sheet and joining an outwardly extended first outboard flange which extends outboard beyond the said second lateral corner;

said liner sheet having a first side edge and a second side edge;

said first side edge of said liner sheet having a second lateral corner extending lengthwise of said liner sheet at the juncture of said liner sheet and a third normal surface extending away from said liner sheet toward a second shoulder which forms a bearing surface facing away from said liner sheet and which in turn joins a second groove-forming surface which is spaced apart from and essentially parallel to said liner sheet and which connects with a fourth normal surface extending away from said liner sheet to connect with a third groove-forming surface spaced apart from said second groove-forming surface and essentially parallel to said liner sheet which connects with a fifth normal surface directed towards said liner sheet which connects to a third shoulder surface spaced apart from said second groove-forming surface and spaced apart from said second shoulder and being essentially parallel to said liner sheet;

said third shoulder surface connecting to a fifth normal surface which extends away from said liner sheet and connects with a second outboard flange which extends essentially parallel to said liner sheet outboard beyond said third lateral corner;

the said second edge of said liner sheet having a fourth lateral corner extending lengthwise of said liner sheet and being the junction of said liner sheet with a second normal wall surface extending away from said liner sheet to a juncture with a third outboard flange which extends outboard beyond said fourth lateral corner essentially parallel to the said liner sheet and which connects with a third sloping surface which extends outwardly and away from said liner sheet and which terminates in a hook-shaped cross-section member;

the said facing sheet and liner sheet being assembled with their first side edges adjoining but out of contact and their second side edges adjoining but out of contact, the said facing sheet being essentially parallel to the said liner sheet.

5. A building wall construction formed from a pair of panels as described in claim 4 with the second side edge of a first panel being secured to a building framework by means of a fastener extending through the said first outboard flange of the second edge of said facing sheet, through the thermal insulation and through the said liner sheet into the structural framework of a building;

clamping means secured by said fastener and overlying the said first outboard flange of the second edge of said first facing sheet and also overlying the second outboard flange of the second edge of said liner sheet;

the said first gutter of the first edge of said facing sheet of the second panel receiving the said first shoulder of the second edge of said facing sheet of the first panel;

the said hook-shaped cross-section member of the second edge of said liner sheet of the first panel being disposed within a groove which is formed in the first edge of said facing sheet of the second panel by the said third groove-forming surface and the said fifth normal surface;

said third outboard flange of said second edge of said liner sheet being supported by the said second shoulder of the said first edge of a said liner sheet of the second panel.

6. The panel construction of claim 4 wherein said clamping means comprises an essentially flat plate having at least one fastener-receiving opening and having at least one flange extending normally from the plane of the plate through the said thermal insulation into engagement with the inner surface of the liner sheet of the first panel, said flange covering the free edge of said first outboard flange of the first panel and covering a portion of the third outboard flange of the second panel.

7. In a building panel wall assembly formed from individual building panels, each panel having an outer metal facing sheet, an inner metal facing sheet and a thermal insulation core adhesively connecting said metal sheets, wherein said outer facing sheet and said inner facing sheet have lateral profiled joint-forming surfaces for connecting a pair of said panels in side-by-side relation; the improvement comprising:

interlocking mechanical connections between the liner sheet of one panel and the liner sheet of the adjoining panel;

a sloping wall surface on each said panel in abutting relation whereby outwardly applied disengagement stresses are transferred in a direction which increases the interlocking compression of said interlocking mechanical connections.

* * * * *